US005691296A

United States Patent [19]

Agar et al.

[11] Patent Number: 5,691,296

[45] Date of Patent: Nov. 25, 1997

[54] PERCARBONATE BLEACH PARTICLES COATED WITH A PARTIALLY HYDRATED CRYSTALLINE ALUMINOSILICATE FLOW AID

[75] Inventors: Joseph Thomas Henry Agar, Lincoln, United Kingdom; Paul Amaat Raymond G. France, Bertem; Carole Patricia D. Wilkinson, Bruxelles, both of Belgium

[73] Assignee: The Procter & Gamble Company, Cincinnati, Ohio

[21] Appl. No.: 581,553

[22] PCT Filed: Jul. 13, 1994

[86] PCT No.: PCT/US94/07876

§ 371 Date: Jan. 16, 1996

§ 102(e) Date: Jan. 16, 1996

[87] PCT Pub. No.: WO95/02672

PCT Pub. Date: Jan. 26, 1995

[30] Foreign Application Priority Data

Jul. 14, 1993 [EP] European Pat. Off. ..... 93870140

[51] Int. Cl.[6] ..... C11D 3/395

[52] U.S. Cl. ..... 510/441; 510/329; 510/315; 510/507; 510/511; 252/381; 252/383; 252/384; 252/385

[58] Field of Search ..... 510/441, 309, 510/315, 507, 511; 252/381, 383, 384, 385

[56] References Cited

U.S. PATENT DOCUMENTS

| | | | |
|---|---|---|---|
| 4,055,505 | 10/1977 | Gray | 252/102 |
| 4,274,975 | 6/1981 | Corkill et al. | 252/140 |
| 4,391,727 | 7/1983 | Benz | 252/99 |
| 4,552,681 | 11/1985 | Koch | 510/441 |
| 4,917,813 | 4/1990 | Aoyagi | 252/DIG. 2 |
| 5,160,654 | 11/1992 | Falou | 252/186.27 |
| 5,236,613 | 8/1993 | Garner-Gray et al. | 252/94 |
| 5,258,132 | 11/1993 | Kamel | 428/403 |
| 5,259,981 | 11/1993 | Chapple | 252/186.31 |
| 5,324,455 | 6/1994 | Dumas | 252/549 |
| 5,356,554 | 10/1994 | Deiwel | 502/167 |
| 5,405,413 | 4/1995 | Willey | 8/111 |

FOREIGN PATENT DOCUMENTS

| | | | |
|---|---|---|---|
| 2 013 259 A | 8/1979 | United Kingdom | C11D 3/12 |

*Primary Examiner*—Paul Lieberman
*Assistant Examiner*—Necholus Ogden
*Attorney, Agent, or Firm*—Jacobus C. Rasser; Jerry J. Yetter; Ken K. Patel

[57] ABSTRACT

A process for making a granular detergent composition comprising the steps of adding to a detergent powder particles of percarbonate having a mean particle size in the range of from 250 to 900 micrometers and a powdery flow aid containing a partially hydrated crystalline sodium aluminosilicate having a moisture content of less than 15%, preferably from 5% to 12%.

17 Claims, No Drawings

PERCARBONATE BLEACH PARTICLES COATED WITH A PARTIALLY HYDRATED CRYSTALLINE ALUMINOSILICATE FLOW AID

TECHNICAL FIELD

The present invention relates to detergent compositions containing percarbonate bleach; it provides a process for making such compositions which yields optimum bleach stability.

BACKGROUND OF THE INVENTION

The inorganic perhydrate bleach most widely used in laundry detergent compositions is sodium perborate in the form of either the monohydrate or tetrahydrate. Our increased interest in other perhydrate salts is being observed, of which sodium percarbonate is the most readily available.

Detergent compositions containing sodium percarbonate are known in the art. Sodium percarbonate is an attractive perhydrate for use in detergent compositions because it dissolves readily in water, is weight efficient and, after giving up its available oxygen, provides a useful source of carbonate ions for detergency purposes.

The inclusion of percarbonate salts in laundry detergent compositions has been restricted hitherto by the relative instability of the bleach. In particular, percarbonate salts decompose rapidly when stored in a moist and/or warm atmosphere. It is known that acceptable storage characteristics may however be obtained through the protection of the carbonate by coating the crystalline product, or by the inclusion of stabilizing agents during its manufacture, or both. A variety of suitable coating agents have been proposed including silicates and mixtures of inorganic sulphate and carbonate salts.

In WO-92-06163 percarbonate-containing detergent compositions have been described, wherein the need for low Equilibrium Relative Humidity as well as low levels of heavy metal ions was disclosed.

There is still, however, the need to improve storage stability of the percarbonate bleach, and to achieve this in all types of detergent compositions, including compositions made by the various making processes currently available.

The Applicants have however unexpectedly discovered that when partially hydrated crystalline aluminosilicate is used as a dusting agent onto the granules of detergent compositions containing the percarbonate bleaching agent, the percarbonate stability is remarkably improved, in all types of compositions.

U.S. Pat. No. 4,427,567 discloses a method for reconditioning caked detergent compositions wherein the caked composition is broken up to form a powder, and said powder is mixed/dusted with a dehydrated zeolite. The disclosed detergent compositions teach to limit the level of perborate or percarbonate at levels below 20% by weight, preferably less than 10% by weight.

JP 61 069897, laid open 10th Apr. 1986 states that aluminosilicate, silicon dioxide, bentonire and clay having an average particle diameter of not more than 10 micrometers can be used as a surface modifier at a level of from 0.5% to 35%; Percarbonate is merely mentioned among the bleach ingredients. The preferred aluminosilicates are amorphous, and no preference for dehydrated material is given.

SUMMARY OF THE INVENTION

A process for making a granular detergent composition comprising the steps of adding to a detergent powder particles of percarbonate having a mean particle size in the range of from 250 to 900 micrometers and a powdery flow aid containing a partially hydrated crystalline sodium aluminosilicate having a moisture content of less than 15%, preferably from 5% to 12%.

DETAILED DESCRIPTION OF THE INVENTION

The process of the present invention is characterized by the addition to a detergent powder of particles of percarbonate, as well as a powdery flow aid, the two additions being conducted in either order, to produce a detergent composition.

By detergent composition herein, is meant laundry detergent composition, as well as automatic dishwashing composition or laundry additive.

The detergent powder

The detergent powder herein is constituted of granular detergent components, each individual component having been prepared by processes such as agglomeration, compaction, encapsulation, grinding or spray-drying, said components being dry-mixed to obtain the detergent powder.

The granular components may be prepared and mixed by any conventional means. Typically the mixing process may be carried out continuously by metering each component by weight on to a moving belt, and blending them in a rotating drum or mixer.

The percarbonate particles herein may be added at any time of the component mixing process.

It is preferred that there is no granular component which has been prepared by spray drying, and which comprises an organic surfactant, which is present at a level of greater than 10% by weight of the finished product. Accordingly, surfactant agglomerates are preferably used; One particularly preferred process of agglomerating high active surfactant pastes with builders and other powders is described in the Applicants' co-pending European Application No. 92200993.1.

It is even more preferred that little or none of the granular components be prepared by spray drying.

The granular components used in the present invention are made from a wide range of ingredients useful for their detergency which are chosen according to the demands of the product formulator. Suitable ingredients are described below.

Anionic Surfactants

In the preferred embodiment herein, where the detergent compositions herein is a laundry detergent composition, compositions of the present invention usually contain one or more anionic surfactants as described below.

Alkyl Ester Sulfonate Surfactant

Alkyl Ester sulfonate surfactants hereof include linear esters of $C_8$–$C_{20}$ carboxylic acids (i.e. fatty acids) which are sulfonated with gaseous $SO_3$ according to "The Journal of the American Oil Chemists Society'" 52 (1975), pp. 323–329. Suitable starting materials would include natural fatty substances as derived from tallow, palm oil, etc.

The preferred alkyl ester sulfonate surfactant, especially for laundry applications, comprises alkyl ester sulfonate

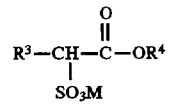

wherein $R^3$ is a $C_8$–$C_{20}$ hydrocarbyl, preferably an alkyl, or combination thereof, $R^4$ is a $C_1$–$C_6$ hydrocarbyl, preferably an alkyl, or combination thereof, and M is a cation which forms a water soluble salt with the alkyl ester sulfonate. Suitable salt-forming cations include metals such as sodium, potassium, and lithium, and substituted or unsubstituted ammonium cations, such as monoethanolamine, diethanolamine, and triethanolamine. Preferably, $R^3$ is $C_{10}$–$C_{16}$ alkyl, and $R^4$ is methyl, ethyl or isopropyl. Especially preferred are the methyl ester sulfonates wherein $R^3$ is $C_{14}$–$C_{16}$ alkyl.

Alkyl Sulfate Surfactant

Alkyl sulfate surfactants hereof are water soluble salts or acids or the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quarternary ammonium cations derived from alkylamines such as ethylamine, diethylamine, triethylamine, and mixtures thereof, and the like). Typically, alkyl chains of $C_{12-16}$ are preferred for lower wash temperatures (e.g., below about 50° C.) and $C_{16-18}$ alkyl chains are preferred for higher wash temperatures (e.g., above about 50° C.).

Alkyl Alkoxylated Sulfate Surfactant

Alkyl alkoxylated sulfate surfactants hereof are water soluble salts or acids of the formula $RO(A)_mSO_3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium and quaternary ammonium cations, such as tetramethyl-ammonium, dimethyl piperdinium and cations derived from alkanolamines such as ethylamine, diethylamine, triethylamine, mixtures thereof, and the like. Exemplary surfactants are $C_{12}$–$C_{18}$ alkyl polyethoxylate (1.0) sulfate, $C_{12}$–$C_{18}E(1.0)M$), $C_{12}$–$C_{18}$ alkyl polyethoxylate (2.25) sulfate, $C_{12}$–$C_{18}E(2.25)M$), $C_{12}$–$C_{18}$ alkyl polyethoxylate (3.0) sulfate $C_{12}$–$C_{18}E(3.0)$, and $C_{12}$–$C_{18}$ alkyl polyethoxylate (4.0) sulfate $C_{12}$–$C_{18}E(4.0)M$), wherein M is conveniently selected from sodium and potassium.

Other Arionic Surfactants

Other anionic surfactants useful for detersive purposes can also be included in the laundry detergent compositions of the present invention. These can include salts (including, for example, sodium, potassium, ammonium, and substituted ammonium salts such as mono-, di- and triethanolamine salts) of soap, $C_9$–$C_{20}$ linear alkylbenzenesulphonates, $C_8$–$C_{22}$ primary or secondary alkanesulphonates, $C_8$–$C_{24}$ olefinsulphonates, sulphonated polycarboxylic acids prepared by sulphonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), acyl sarcosinates, sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_kCH_2COO—M^+$ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

When included therein, the laundry detergent compositions of the present invention typically comprise from about 1% to about 40%, preferably from about 3% to about 20% by weight of such anionic surfactants.

Nonionic Surfactants

While any nonionic surfactant may be normally employed in the present invention, two families of nonionics have been found to be particularly useful. These are nonionic surfactants based on alkoxylated (especially ethoxylated) alcohols, and those nonionic surfactants based on amidation products of fatty acid esters and N-alkyl polyhydroxy amine. The amidation products of the esters and the amines are generally referred to herein as polyhydroxy fatty acid amides. Particularly useful in the present invention are mixtures comprising two or more nonionic surfactants wherein at least one nonionic surfactant is selected from each of the groups of alkoxylated alcohols and the polyhydroxy fatty acid amides.

Suitable nonionic surfactants include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Particularly preferred for use in the present invention are nonionic surfactants such as the polyethylene oxide condensates of alkyl phenols, e.g., the condensation products of alkyl phenols having an alkyl group containing from about 6 to 16 carbon atoms, in either a straight chain or branched chain configuration, with from about 4 to 25 moles of ethylene oxide per mole of alkyl phenol.

Preferred nonionics are the water-soluble condensation products of aliphatic alcohols containing from 8 to 22 carbon atoms, in either straight chain or branched configuration, with an average of up to 25 moles of ethylene oxide per more of alcohol. Particularly preferred are the condensation products of alcohols having an alkyl group containing from about 9 to 15 carbon atoms with from about 2 to 10 moles of ethylene oxide per mole of alcohol; and condensation products of propylene glycol with ethylene oxide. Most preferred are condensation products of alcohols having an alkyl group containing from about 12 to 15 carbon atoms with an average of about 3 moles of ethylene oxide per mole of alcohol.

The nonionic surfactant system can also include a polyhydroxy fatty acid amide component.

Polyhydroxy fatty acid amides may be produced by reacting a fatty acid ester and an N-alkyl polyhydroxy amine. The preferred amine for use in the present invention is N—(R1)—CH2 (CH2OH)4—CH2—OH and the preferred ester is a C12–C20 fatty acid methyl ester. Most preferred is the reaction product of N-methyl glucamine with C12–C20 fatty acid methyl ester.

Methods of manufacturing polyhydroxy fatty acid amides have been described in WO 92 6073, published on 16th Apr., 1992. This application describes the preparation of polyhydroxy fatty acid amides in the presence of solvents. In a highly preferred embodiment of the invention N-methyl glucamine is reacted with a C12–C20 methyl ester. It also says that the formulator of granular detergent compositions may find it convenient to run the amidation reaction in the presence of solvents which comprise alkoxylated, especially ethoxylated (EO 3-8) C12–C14 alcohols (page 15, lines 22–27). This directly yields nonionic surfactant systems which are preferred in the present invention, such as those comprising N-methyl glucamide and C12–C14 alcohols with an average of 3 ethoxylate groups per molecule.

Nonionic surfactant systems, and granular detergents made from such systems have been described in WO 92 6160, published on 16th Apr., 1992. This application describes (example 15) a granular detergent composition prepared by fine dispersion mixing in an Eirich RV02 mixer which comprises N-methyl glucamide (10%), nonionic surfactant (10%).

Both of these patent applications describe nonionic surfactant systems together with suitable manufacturing processes for their synthesis, which have been found to be suitable for use in the present invention.

The polyhydroxy fatty acid amide may be present in compositions of the present invention at a level of from 0% to 50% by weight of the detergent component or composition, preferably from 5% to 40% by weight, even more preferably from 10% to 30% by weight.

Other Surfactants

The laundry detergent compositions of the present invention may also contain cationic, ampholytic, zwitterionic, and semi-polar surfactants, as well as nonionic surfactants other than those already described herein, including the semi-polar nonionic amine oxides described below.

Cationic detersive surfactants suitable for use in the laundry detergent compositions of the present invention are those having one long-chain hydrocarbyl group. Examples of such cationic surfactants include the ammonium surfactants such as alkyldimethylammonium halogenides, and those surfactants having the formula:

$$[R^2(OR^3)y][R^4(OR^3)y]_2R^5N+X-$$

wherein R2 is an alkyl or alkyl benzyl group having from about 8 to about 18 carbon atoms in the alkyl chain, each $R^3$ is selected from the group consisting of $—CH_2CH_2—$, $—CH_2CH(CH_3)—$, $—CH_2CH(CH_2OH)—$, $—CH_2CH_2CH_2—$, and mixtures thereof; each $R^4$ is selected from the group consisting of $C_1$–$C_4$ alkyl, $C_1$–$C_4$ hydroxyalkyl, benzyl ring structures formed by joining the two $R^4$ groups, $—CH_2COH—CHOHCOR^6CHOHCH_2OH$ wherein R6 is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Other cationic surfactants useful herein are also described in U.S. Pat No. 4,228,044, Cambre, issued Oct. 14, 1980, incorporated herein by reference.

When included therein, the laundry detergent compositions of the present invention typically comprise from 0% to about 25%, preferably form about 3% to about 15% by weight of such cationic surfactants.

Ampholytic surfactants are also suitable for use in the laundry detergent compositions of the present invention. These surfactants can be broadly described as aliphatic derivatives of secondary or tertiary amines, or aliphatic derivatives of heterocyclic secondary and tertiary amines in which the aliphatic radical can be straight- or branched chain. One of the aliphatic substituents contains at least 8 carbon atoms, typically from about 8 to about 18 carbon atoms, and at least one contains an anionic water-solubilizing group e.g. carboxy, sulfonate, sulfate. See U.S. Pat. No. 3,929,678 to Laughlin et al., issued Dec. 30, 1975 at column 19, lines 18–35 (herein incorporated by reference) for examples of ampholytic surfactants.

When included therein, the laundry detergent compositions of the present invention typically comprise form 0% to about 15%, preferably from about 1% to about 10% by weight of such ampholytic surfactants.

Zwitterionic surfactants are also suitable for use in laundry detergent compositions. These surfactants can be broadly described as derivatives of secondary and tertiary amines, derivates of heterocyclic secondary and tertiary amines, or derivatives of quaternary ammonium, quarternary phosphonium or tertiary sulfonium compounds. See U.S. Pat. No. 3,929,678 to Laughlin et al., issued Dec. 30, 1975 at columns 19, line 38 through column 22, line 48 (herein incorporated by reference) for examples of zwitterionic surfactants.

When included therein, the laundry detergent compositions of the present invention typically comprise form 0% to about 15%, preferably from about 1% to about 10% by weight of such zwitterionic surfactants.

Semi-polar nonionic surfactants are a special category of nonionic surfactants which include water-soluble amine oxides containing one alkyl moiety of from about 10 to about 18 carbon atoms and 2 moieties selected from the group consisting af alkyl groups and hydrocyalkyl groups containing form about 1 to about 3 carbon atoms; water-soluble phosphine oxides containing one alkyl moiety of form about 10 to about 18 carbon atoms and 2 moieties selected form the group consisting of alkyl groups and hydroxyalkyl groups containing from about 1 to about 3 carbon atoms.

Semi-polar nonionic detergent surfactants include the amine oxide surfactants having the formula:

$$R^3(OR^4)xN(\overset{O}{\overset{|}{R^5}})2$$

Builder

The compositions herein preferably contain a builder, most preferably non-phosphate detergent builders. These can include, but are not restricted to alkali metal carbonates, bicarbonates, silicates, aluminosilicates, carboxylates and mixtures of any of the foregoing. The builder system is present in an amount of from 25% to 80% by weight of the composition, more preferably from 30% to 60% by weight.

Suitable silicates are those having an $SiO_2$:$Na_2O$ ratio in the range from 1.6 to 3.4, the so-called amorphous silicates of $SiO_2$:$Na_2O$ ratios from 2.0 to 2.8 being preferred.

Within the silicate class, highly preferred materials are crystalline layered sodium silicates of general formula $$NaMSi_xO_{2x}+1.yH2O$$

wherein M is sodium or hydrogen, x is a number from 1.9 to 4 and y is a number from 0 to 20. Crystalline layered sodium silicates of this type are disclosed in EP-A-0164514 and methods for their preparation are disclosed in DE-A-3417649 and DE-A-3742043. For the purposes of the present invention, x in the general formula above has a value of 2,3 or 4 and is preferably 2. More preferably M is sodium and y is 0 and preferred examples of this formula comprise the, and forms of $Na_2Si_2O_5$. These materials are available from Hoechst AG FRG as respectively NaSKS-5, NaSKS-7, NaSKS-11 and NaSKS-6. The most preferred material is —$Na_2Si_2O_5$, NaSKS-6. Crystalline layered silicates are incorporated either as dry mixed solids, or as solid components of agglomerates with other components.

Whist a range of aluminosilicate ion exchange materials can be used, preferred sodium aluminosilicate zeolites have the unit cell formula $$Na_z[(AlO_2)_z.(SiO_2)_y].xH_2O$$

wherein z and y are at least about 6, the molar ratio of z to y is from about 1.0 to about 0.4 and z is from about 10 to about 264. Amorphous hydrated aluminosilicate materials useful herein have the empirical formula $$M_z(zAlO_2.ySiO_2)$$

wherein M is sodium, potassium, ammonium or substituted ammonium, z is from about 0.5 to about 2 and y is 1, said material having a magnesium ion exchange capacity of at least about 50 milligram equivalents of $CaCO_3$ hardness per gram of anhydrous aluminosilicate. Hydrated sodium Zeolite A with a particle size of from about 1 to 10 microns is preferred.

The aluminosilicate ion exchange builder materials herein are in hydrated form and contain from about 10% to about 28% of water by weight if crystalline, and potentially even higher amounts of water if amorphous. Highly preferred crystalline aluminosilicate ion exchange materials contain from about 18% to about 22% water in their crystal matrix. The crystalline aluminosilicate ion exchange materials are further characterized by a particle size diameter of from about 0.1 micron to about 10 microns. Amorphous materials are often smaller, e.g., down to less than about 0.01 micron. Preferred ion exchange materials have a particle size diameter of from about 0.2 micron to about 4 microns. The term "particle size diameter" herein represents the average particle size diameter by weight of a given ion exchange material as determined by conventional analytical techniques such as, for example, microscopic determination utilizing a scanning electron microscope.

Aluminosilicate ion exchange materials useful in the practice of this invention are commercially available. The aluminosilicates useful in this invention can be crystalline or amorphous in structure and can be naturally occurring aluminosilicates or synthetically derived. A method for producing aluminosilicate ion exchange materials is discussed in U.S. Pat. No. 3,985,669, Krummel et al., issued Oct. 12, 1976, incorporated herein by reference. Preferred synthetic crystalline aluminosilicate ion exchange materials useful herein are available under the designations Zeolite A, Zeolite B, Zeolite X, P and MAP, the latter species being described in EPA 384070. In an especially preferred embodiment, the crystalline aluminosilicate ion exchange material is a Zeolite A having the formula $$Na_{12}[(AlO_2)_{12}(SiO2)_{12}].xH_2O$$

wherein x is from about 20 to about 30, especially about 27 and has a particle size generally less than about 5 microns.

Suitable carboxylate builders containing one carboxy group include lactic acid, glycollic acid and ether derivatives thereof as disclosed in Belgian Patent Nos. 831,368, 821,369 and 821,370. Polycarboxylates containing two carboxy groups include the water-soluble salts of succinic acid, malonic acid, (ethylenedioxy) diacetic acid, maleic acid, diglycollic acid, tartaric acid, tartronic acid and fumaric acid, as well as the ether carboxylates described in German Offenlegenschrift 2,446,686 and 2,446,687 and U.S. Pat. No. 3,935,257 and the sulfinyl carboxylates described in Belgian Patent No. 840,623. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in Netherlands Application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829,1, and the 1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,082,179, while polycarboxylates containing phosphone substituents are disclosed in British Patent No. 1,439,000.

Alicyclic and heterocyclic polycarboxylates include cyclopentane-cis,cis,cis-tetracarboxylates, cyclopentadienide pentacarboxylates, 2,3,4,5-tetrahydrofuran-cis,cis,cis-tetracarboxylates, 2,5-tetrahydrofuran -cis-dicarboxylates, 2,2,5,5,-tetrahydrofuran-tetracarboxylates, 1,2,3,4,5,6-hexane hexacarboxylates and carboxymethyl derivatives of polyhydric alcohols such as sorbitol, mannitol and xylitol. Aromatic polycarboxylates include mellitic acid, pyromellitic acid and the phtalic acid derivates disclosed in British Patent No. 1,425,343.

Of the above, the preferred polycarboxylates are hydroxycarboxylates containing up to three carboxy groups per molecule, more particularly citrates.

The parent acids of the monomeric or oligomeric polycarboxylate chelating agents or mixtures thereof with their salts, e.g. citric acid or citrate/citric acid mixtures are also contemplated as components of builder systems useful in the present invention.

In another embodiment of the invention, are provided Automatic Dishwashing Compositions Automatic dishwashing compositions typically contain, in addition to the percarbonate and partially hydrated of the invention, a builder, such as described above, and a source of alkalinity, such as silicate or carbonate, those ingredients amounting to up to 70% of the formulation. Optional ingredients include polymers and enzymes.

In still another embodiment of the invention, are provided Laundry Additive Compositions such compositions typically contain in addition to the percarbonate and partially hydrated zeolite of the invention, a builder and a source of alkalinity.

Optional Ingredients

Other ingredients which are known for use in detergent compositions within the meaning herein may also be used as optional ingredients in the detergent powder of the present invention, such as bleach activators, other bleaching agents, polymers, enzymes, suds suppressing agents, as well as dyes, fillers, optical brighteners, pH adjusting agents, non builder alkalinity sources, enzyme stability agents, hydrotopes, perfumes.

Preferably, the present compositions also contain from 1% to 20% by weight of the composition, preferably from 2% to 15% by weight, most preferably from 3% to 10% by weight of a peroxyacid bleach activator.

Peroxyacid bleach activators (bleach precursors) as additional bleaching components in accord with the invention can be selected from a wide range of class and are preferably those containing one or more N-or O-acyl groups.

Suitable classes include anhydrides, esters, amides, and acylated derivatives of imidazoles and oximes, and examples of useful materials within these classes are disclosed in GB-A-1586789. The most preferred classes are esters such as are disclosed in GB-A-836 988, 864,798, 1 147 871 and 2 143 231 and amides such as are disclosed in GB-A-855 735 and 1 246 338.

Particularly preferred bleach activator compounds as additional bleaching components in accord with the invention are the N-,N,N'N' tetra acetylated compounds of the formula

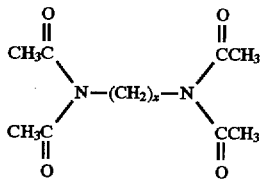

where x can be 0 or an integer between 1 and 6.

Examples include tetra acetyl methylene diamine (TAMD) in which x=1, tetra acetyl ethylene diamine (TAED) in which x=2 and Tetraacetyl hexylene diamine (TAHD) in which x=6. These and analogous compounds are described in GB-A-907 356. The most preferred peroxyacid bleach activator as an additional bleaching component is TAED.

Another preferred class of peroxyacid bleach compounds are the amide substituted compounds of the following general formulae:

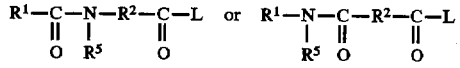

wherein $R^1$ is an aryl or alkaryl group with from about 1 to about 14 carbon atoms, $R^2$ is an alkylene, arylene, and alkarylene group containing from about 1 to about 14 carbon atoms, and $R^5$ is H or an alkyl, aryl, or alkaryl group containing 1 to 10 carbon atoms and L can be essentially any leaving group. $R^1$ preferably contains from about 6 to 12 carbon atoms. $R^2$ preferably contains from about 4 to 8 carbon atoms. $R^1$ may be straight chain or branched alkyl, substituted aryl or alkylaryl containing branching, substitution, or both and may be sourced from either synthetic sources or natural sources including for example, tallow fat. Analogous structural variations are permissible for $R^2$. The substitution can include alkyl, aryl, halogen, nitrogen, sulphur and other typical substituent groups or organic compounds. $R^5$ is preferably H or methyl. $R^1$ and $R^5$ should not contain more than 18 carbon atoms total. Amide substituted bleach activator compounds of this type are described in EP-A-0170386.

In addition to percarbonate, the compositions herein may also contain another bleaching system such as perborate and activator, or a preformed organic peracid or perimidic acid, such as N,N phthaloylaminoperoxy caproic acid, 2-carboxyphtaloylaminoperoxy caproic acid, N,N phthaloylaminoperoxy valeric acid, Nonyl amide of peroxy adipic acid, 1,12 diperoxydodecanedoic acid, Peroxybenzoic acid and ring substituted peroxybenzoic acid, Monoperoxyphtalic acid (magnesium salt, hexhydrate), Diperoxybrassylic acid.

The percarbonate particles

As mentioned earlier the percarbonate particles are dry-mixed with the other granular components of the detergent powder.

The compositions herein contain from 1% to 40%, preferably from 3% to 30% by weight, most preferably from 5% to 25% by weight of an alkali metal percarbonate bleach; in the form of particles having a mean size from 250 to 900 micrometers, preferably 500 to 700 micrometers.

When the present compositions are laundry additives, the level of percarbonate is typically in the range of 20% to 80% by weight.

The alkali metal percarbonate bleach is usually in the form of the sodium salt. Sodium percarbonate is an addition compound having a formula corresponding to $2Na_2CO_3$ $3H_2O_2$. to enhance storage stability the percarbonate bleach can be coated with a further mixed salt of an alkali metal sulphate and carbonate. Such coatings together with coating processes have previously been described in GB-1,466,799, granted to Interox on Mar. 9, 1977. The weight ratio of the mixed salt coating material to percarbonate lies in the range from 1:2000 to 1:4, more preferably from 1:99 to 1:9, and most preferably from 1:49 to 1:19. Preferably, the mixed salt is of sodium sulphate and sodium carbonate which as the general formula Na2SO4.n.Na2CO3 wherein n is from 0.1 to 3, preferably n is from 0.3 to 1.0 and most preferably n is from 0.2 to 0.5.

Other suitable coating materials are sodium silicate, of SiO2:Na2O ratio from 1.6:1 to 2.8:1, and magnesium silicate.

Commercially available carbonate/sulphate coated percarbonate bleach may include a low level of a heavy metal sequestrant such as EDTA, 1-hydroxyethylidene 1,1-diphosphonic acid (HEDP) or an aminophosphonate, that is incorporated during the manufacturing process. diphosphonic.

Preferred heavy metal sequestrants for incorporation as described herein above include the organic phosphonates and amino alkylene poly(alkylene phosphonates) such as the alkali metal ethane 1-hydroxy diphosphonates, the nitrilo trimethylene phosphonates, the ethylene diamine tetra methylene phosphonates and the diethylene triamine penta methylene phosphonates.

Especially when making a laundry detergent composition, the percarbonate-containing detergent powder preferably has a bulk density above 650 g/l.

It is another characteristic of the process of the present invention, that a powdery flow aid be added to the detergent powder, before or after addition of the percarbonate.

The flow aid

The admixing can take place in any suitable mixing equipment, including fluidized beds and one or more various rotating drums or mixers with a rotating shaft, such as ribbon blenders or low shear mixers supplied by Lödige Machinenbau GmbH, Paderborn, Germany (especially those mixers supplied under the Trade Mark Loedige KM). Such a low shear mixer comprises mixing tools, often of the "ploughshare" type mounted on to the rotating shaft. If a low shear mixer is used, the rotational speed of the shaft should be less than 250 rpm.

In a preferred execution herein, a nonionic surfactant is first sprayed on to the percarbonate-containing detergent powder before admixing with the flow aid; this element can be used to bring to bulk density of the finished components to values in the range of 800 g/l or greater.

It is preferred that the liquid sprayed on to the mix of granular components comprises nonionic surfactant. Useful nonionic surfactants have been described hereinabove. Particularly preferred are the condensation products of alcohols having an alkyl group containing from about 9 to 15 carbon atoms with from about 4 to 25 moles of ethylene of propylene glycol with ethylene oxide.

Other liquid ingredients may also be sprayed on to the mix of granular components either separately or premixed.

Typically perfume and slurries of optical brightener may be sprayed. Although any optical brightener may be added in this way, it has been found that Colour Index Fluorescent Brightener number 351 (as published by the Society of Dryers and Colourists and the American Association of Textile Chemists and Colourists) gives particular benefits of colour stability.

It is a key element of the present invention that the flow aid contains or consists of a partially hydrated aluminosilicate.

Aluminosilicate ion exchange materials useful in the practice of this invention are derived from commercially available species. The aluminosilicates useful in this invention are crystalline in structure and are preferably synthetically derived. A method for producing aluminisilicate ion exchange materials is discussed in U.S. Pat. No. 3,985,669, Krummel et al., issued Oct. 12, 1976, incorporated herein by reference.

Preferred such synthetic crystalline aluminosilicate ion exchange materials are available under the designations Zeolite A and Zeolite X, as well as zeolite P and Zeolite MAP, described in EP-A-0170386. In an especially preferred embodiment, the present crystalline aluminosilicate ion exchange material is derived from Zeolite A, which has the formula $$Na_{12}[(AlO_2)_{12}(SiO_2)_{12}].xH_2O$$

wherein x is from about 20 to about 30, and has a particle size generally less than about 5 microns.

It is an essential feature of the present invention that said crystalline aluminosilicates be in a partially hydrated form; by partially hydrated form, it is meant that the crystalline aluminosilicate materials described above are subjected to dehydration processes in order to bring the hydration level in the range found useful in the context of the present invention.

Such a hydration level should not be higher than 15% by weight of the aluminosilicate material, and can be as low as 1.5%, which corresponds to substantially anhydrous forms.

The preferred hydration level has been found to be in the range 5% to 12%.

Dehydration processes are well known in the art, and include high temperature dehydration processes, which typically yield calcinated material with hydration levels below 5%; and is normally practiced to prepare e.g. zeolite A crystals for use as cracking catalysts.

However, if the high temperature dehydration process is suspended before dehydration is complete, or the temperature to which the hydrated zeolite is raised for dehydration is lower, a partially hydrated form of the zeolite is obtained, and the process can be adapted to obtain the desired moisture content, e.g., the preferred 5–12% range of the present invention, still capable of sorbing at least 10% (anhydrous basis) of moisture.

In addition to the partially hydrated aluminosilicate, the powdery flow aid can also comprise a hydrophobic silica, at levels of up to 30% by weight of the flow aid.

Silica is a highly dispersed amorphous silicon dioxide. It is commercially available in many forms. Most commonly silica has a tapped density of from 50 g/l to 120 g/l. The specific surface area of the particles ranges from 25 square meters per gram to 800 square meters per gram.

The surface of silica particles can be chemically modified to change their behaviour with respect to water. For example, silica particles may be treated with organosilanes to make the particles predominantly hydrophobic. It has been found that silicas must be hydrophobised to be useful in the present invention.

In commercial practice, silica is usually prepared by one of two techniques; either by precipitation or by high temperature flame hydrolysis. Precipitated silicas generally have an agglomerate size of from 3 micrometers to 100 micrometers, whereas fumed silicas (made by flame hydrolysis) usually have primary particles which are generally spherical and have an average diameter of from 7nm to 40nm. Fumed silicas having an average primary particle size of from 7 to 25 nanometers are preferred in the present invention.

Examples of silicas which are particularly useful in the present invention include those supplied by Degussa AG, Frankfurt, Germany under the Trade Name "Aerosil". Aerosil R972 has been found to be particularly useful. This silica is a hydrophobic, fumed silica which has a specific surface area of about 110 square meters per gram and an average primary particle size of 16 nanometers.

The powdery flow aid of the present invention can alternatively comprise Wessalith DAY, Hydrotalcit, talc, or a wax having a melting point above 40° C.

EXAMPLES

In these examples the following abbreviations have been used:

C45AS: Sodium $C_{14}$–$C_{15}$ alkyl sulfate

C35AE3S: $C_{13}$–$C_{15}$ alkyl ethersulfate containing an average of three ethoxy groups per mole CMC: Sodium carboxymethyl cellulose C25E3: A $C_{12-15}$ primary alcohol condensed with an average of 3 moles of ethylene oxide C45E7: A $C_{14-15}$ primary alcohol condensed with an average of 7 moles of ethylene oxide TAED: Tetraacetyl ethylene diamine Polymer: Copolymer of 1:4 maleic/acrylic acid, average MW 80,000

Example I

The following granular laundry detergent composition was prepared:

| | % by weight |
|---|---|
| Anionic surfactant agglomerate* | 30 |
| Layered silicate compacted granule (supplied by Hoechst under trade name SKS-6) | 18 |
| Percarbonate (supplied by Interox)** | 25 |
| TAED agglomerate | 9 |
| Suds suppressor agglomerate | 2 |
| Perfume encapsulate | 0.2 |
| Granular dense soda ash | 8.4 |
| Granular acrylic-maleic copolymer | 3.2 |
| Enzymes | 3.6 |
| Granular soil release polymer | 0.6 |

*Anionic surfactant agglomerates were made from a 78% active surfactant paste which comprises C45AS/C35AE3S in the ratio of 80:20. The paste was agglomerated with a powder mixture according to the process described in EPA510746. The resulting anionic surfactant granule had a composition of 30% C45AS, 7.5% C35AE3S, 24% zeolite, 20% carbonate, 2.5% CMC, 12% acrylic-maleic co-polymer, and the balance of moisture.
**Percarbonate coated with 2.5% carbonate/sulphate with mean particle size of 500 microns.

The granular detergent compositions listed above was placed inside a 140 liter rotating drum that operates at 25 rpm. While operating the drum a mixture of nonionic surfactant (C25E3) and a 20% aqueous solution of optical brightener at ratios of 14:1 were sprayed onto the granular composition to a level of 7% by weight of the granular compositions. The spraying time was about 1–2 minutes. Immediately afterwards, perfume was sprayed on, at a level of 0.5% by weight of the granular composition, while rotating the drum. Then, without stopping the rotation of the drum, a flow aid was slowly added to the mixer, taking about 30 seconds. In the Example 1 composition according to the present invention, the type of flow aid used is de-hydrated zeolite A (moisture content of 6%) and the level of addition was 8%. Once the addition of flow aid was finished, the mixer was allowed to rotate for about 1 minute and was then stopped. The finished product was then removed from the rotating drum.

In comparative Composition A, the type of flow aid used is a hydrated zeolite (16% hydration level, supplied by Degussa) and the level of addition was 8%. Once the addition of flow aid was finished, the mixer was allowed to rotate for about 1 minute and was then stopped. The finished product was then removed from the rotating drum.

2 kg of respectively, example 1 and composition A product are packed in a closed carton, and stored in a 35° C./80% eRH atmosphere (Equilibrium Relative Humidity).

The percarbonate recovery was measured as follows:

| Storage Conditions | Example 1 | Composition A |
|---|---|---|
| 2 weeks 35° C./80% eRH | 73% | 68 |
| 3 weeks 35° C./80% eRH | 67% | 58 |
| 4 weeks 35° C./80% eRH | 60% | 47 |

The above results show the criticality of using a zeolite with a hydration level according to the present invention in order to optimize percarbonate stability in the product.

Example II

A laundry detergent composition (percent by weight versus total composition) is prepared according to the following process steps:

Spray-dried powder (54%) is densified in a high shear mixer, together with C25E3 surfactant (5%), the moisture level being 6%.

Then sodium percarbonate particles (17%), TAED particles (5%), sodium silicate (4%), as well as enzyme granules (1.5%) are mixed in a rotating drum with the above powder.

C25E3 surfactant (3%), suds suppressor (1%) and perfume (0.5%) are sprayed in the drum, and 3% of dehydrated zeolite A with 6% moisture level are added as flow aid in the drum.

Example III

A laundry detergent composition (percent by weight versus total composition) is prepared according to the following process steps:

Spray-dried powder (45%), nonionic carrier granules (20%), surfactant paste (8%) and water (2%) are mixed and extruded in a twin screw extruder.

Dehydrated zeolite A, at 10% moisture level is added to the extrudates in a fluid bed.

Then sodium percarbonate particles (15%), enzyme granules (1.5%), TAED particles (4%) are dry mixed in a rotating drum; finally, C45E7 nonionic surfactant (3%), suds suppressor (1%) and perfume (0.5%) are sprayed on in the rotating drum.

Example IV

An automatic dishwashing detergent composition (percent by weight versus total composition) is prepared according to the following process steps:

Sodium carbonate (5%), sodium silicate (16%), sodium citrate (42%), polymer (4%), TAED (3%), sodium percarbonate particles (10%) enzyme granules (2%) and sodium sulphate (13%) are mixed in a rotating drum.

Nonionic surfactant (1%) is sprayed on in the drum. Dehydrated Zeolite A (10% hydration level) is added as flow aid in the drum.

EXAMPLE V

The following laundry detergent composition was prepared:

| | % |
|---|---|
| Surfactant Agglomerate | |
| Zeolite A | 16 |
| Zeolite MAP | 16 |
| C24AS 5 | 5 |
| C24E5 | 10 |
| Moisture | 3 |
| Dry-mixing | |
| Percarbonate | 18 |
| TAED | 5 |
| Sodium silicate | 5 |
| Sodium carbonate | 5 |
| Chelant | 0.5 |
| Enzyme | 3 |
| Brightener | 0.2 |
| Antifoam | 3 |
| Spray-on | |
| C245 | 5 |
| Perfume | 0.3 |
| Dusting (flow aid) | |
| Zeolite MAP (5% moisture) | 5 |

The surfactant agglomerates were produced by combining an anionic surfactant paste, alcohol ethoxylate and detergent powders and agglomerating together in a Eirich mixer RVO2. The resulting agglomerates were sieved and mixed directly with the other dry ingredients in a rotating drum, where nonionic surfactant was sprayed on along the perfume. The resulting product was then passed to a Loedige FM Ploughshare mixer, where it was dusted with the Zeolite MAP.

What is claimed is:

1. A process for making a granular detergent composition having a bulk density of at least 650 g/l, which process comprises the steps of:

a) providing a detergent powder wherein from 1% to 40% by weight of the detergent powder comprises percarbonate particles having a particle size in the range of 250 to 900 μm;

b) spraying onto said detergent powder a nonionic surfactant; and c) mixing the product of step b) with a partially hydrated crystalline zeolite having a moisture content of less than 15% by weight of the crystalline zeolite, the crystalline zeolite being employed in an amount sufficient to improve the storage life of the percarbonate particles.

2. The process according to claim 1, wherein the percarbonate particles are present in the detergent powder at a concentration of between 3% and 30% by weight.

3. The process according to claim 1, wherein the percarbonate particles are present in the detergent powder at a concentration of between 5% and 25% by weight.

4. The process according to claim 1, wherein the percarbonate particles have a particle size in the range of from 500 to 700 μm.

5. The process according to claim 1, wherein the percarbonate particles are coated with a material which is an alkali metal salt selected from the group consisting of sulphates, carbonates and mixtures thereof.

6. The process according to claim 5, wherein the weight ratio of the coating material to percarbonate bleach particles is in the range of from 1:2000 to 1:4.

7. The process according to claim 5, wherein the weight ratio of the coating material to percarbonate bleach particles is in the range from 1:49 to 1:19.

8. The process according to claim 1, wherein the nonionic surfactant sprayed on the detergent powder is a condensation product of alcohol having an alkyl group containing from about 9 to 15 carbon atoms with from about 2 to 10 moles of ethylene oxide per mole of alcohol.

9. The process according to claim 8, wherein the bulk density of the detergent powder after it is sprayed with the nonionic surfactant in step b) is greater than 800 g/l.

10. The process according to claim 1, wherein the crystalline zeolite is aluminosilicate.

11. The process according to claim 10, wherein the crystalline zeolite has the formula:

$$Na_{12}[(AlO_2)_{12}(SiO_2)_{12}].xH_2O$$

wherein x is from about 20 to about 30.

12. The process according to claim 11, wherein the crystalline zeolite has a particle size of less than 5 μm.

13. The process according to claim 1, wherein the crystalline zeolite has a moisture content of 5% to 12% by weight.

14. The process according to claim 1, wherein the crystalline zeolite contains up to 30% by weight of a hydrophobic silica.

15. The process according to claim 1, wherein liquid ingredients selected from the group consisting of perfumes, optical brighteners and mixtures thereof, are sprayed onto the granular detergent composition.

16. The process according to claim 1, wherein the nonionic surfactant sprayed on the detergent powder is a condensation product of an alkyl phenol having a straight or branched chain alkyl group containing from 6 to 16 carbon atoms, with from about 4 to 25 moles of ethylene oxide per mole of alkyl phenol.

17. The process according to claim 1, wherein the nonionic surfactant sprayed on the detergent powder is a condensation product of an alcohol having an alkyl group containing from about 12 to 15 carbon atoms with an average of about 3 moles of ethylene oxide per mole of alcohol.

* * * * *